United States Patent [19]

Venn

[11] Patent Number: 4,995,951

[45] Date of Patent: Feb. 26, 1991

[54] BRIGHTENING METHOD

[75] Inventor: Peter Venn, Wuppertal, Fed. Rep. of Germany

[73] Assignee: Gebr. Happich GmbH, Fed. Rep. of Germany

[21] Appl. No.: 528,058

[22] Filed: May 23, 1990

[30] Foreign Application Priority Data

May 26, 1989 [DE] Fed. Rep. of Germany ..... 3917184

[51] Int. Cl.[5] ..... C25F 3/20

[52] U.S. Cl. ..... 204/129.95

[58] Field of Search ..... 204/129.95

[56] References Cited

U.S. PATENT DOCUMENTS 4,247,378 1/1981 Harris ..... 204/129.95

*Primary Examiner*—T. M. Tufariello

*Attorney, Agent, or Firm*—Ostrolenk, Faber, Gerb & Soffen

[57] ABSTRACT

A brightening method for parts of aluminum or aluminum alloy is described which is characterized, in particular, by the fact that the parts are treated in an alkaline electrolyte, operated with direct current, preferably having the composition

| | |
|---|---|
| $Na_3PO_4$ (trisodium phosphate) | 120 g/l |
| $NA_2CO_3$ (disodium carbonate) | 330 g/l |
| $AlPO_4$ (aluminum phosphate) | 10 g/l |
| beechwood extracts | 5 ml/l |

at an operating temperature of about 70°-80° C.

10 Claims, No Drawings

BRIGHTENING METHOD

BACKGROUND OF THE INVENTION

The present invention relates to a brightening method for parts of aluminum or aluminum alloy.

Aluminum parts such as aluminum stampings or rolled sections are used, inter alia, in the hardware and lighting industries or, in particular, in automobile manufacture, for example, for window mounting systems or else as ornamental frames, ornamental moldings and the like. In this connection it is also known to use parts of aluminum or aluminum alloy which have a colored anodized surface. In such case, the parts are as a rule subjected to a brightening treatment as a preliminary stage before their coloring (both in natural color and also colored). One known brightening treatment for aluminum or aluminum-alloy parts is the so-called "Brytal" method (see Wernick, Pinner "Die Oberflähenbehandlung von Aluminium" [The Surface Treatment of Aluminum] 1969, p. 84). However, it has been found that a glossy structure or "orange rind" disadvantageously forms on chemically brightened aluminum parts produced by the Brytal method. This disadvantage is present also when acid brightening electrolytes ar used.

The object of the present invention is to provide a method for brightening aluminum or aluminum alloy parts to produce an optimum surface reflection or brightness effect on the parts.

SUMMARY OF THE INVENTION

In accordance with the invention, this object is achieved by treating the aluminum or aluminum alloy parts in an alkaline electrolyte subjected to direct current, of a composition comprising trisodium phosphate, disodium carbonate, aluminum phosphate, and beechwood extracts. An operating temperature of about 70°-80° C. is preferably employed.

The particular advantage of this method resides in the production of an optimum surface reflection or brightening effect of the aluminum parts (profiled moldings or the like) preliminary to the production of colored and natural-color anodically produced anodized, i.e., oxide layers. In this way, there is obtained the further substantial advantage of a considerable reduction in the reworking required because of defects in brightness.

The parts are preferably subjected to a two-stage treatment in the electrolyte, the parts being pre-brightened in the first stage at an operating temperature of about 80° C. and then brightened again in the second stage at an operating temperature of about 70° C. The procedure is therefore performed in two stages, prebrightening and after-brightening, the two stages utilizing a similar composition and differing merely in the operating temperature.

One particularly advantageous further feature of the invention resides in recovering and reusing the chemicals employed in the process. In accordance with this feature, the electrolyte is filtered (continuously or discontinuously), the filter cake thereby obtained is washed, and the chemicals which are thereby recovered in dissolved form are added again to the electrolyte. By this measure, the method of the invention is made particularly compatible with the environment, and furthermore a considerable reduction in cost with respect to disposal expenses and the direct disposal ordinance is obtained. The electrolyte may suitably be filtered by means of a chamber filter press.

Furthermore, the aluminum or aluminum alloy parts can be treated in a cathodically connected container of structural steel, the parts being used as anodes. It can also be provided that a container equipped with heating and/or cooling means is used. Finally, it is advantageous to use a container which has an overflow leading to a filter station and an inlet coming from the filter station.

DESCRIPTION OF THE PREFERRED EMBODIMENT

In a preferred embodiment, the aluminum or aluminum alloy parts are brightened by treating them in an alkaline electrolyte subjected to direct current, the electrolyte having the composition:

| | |
|---|---|
| $Na_3PO_4$ (trisodium phosphate) | 120 g/l |
| $NA_2CO_3$ (disodium carbonate) | 330 g/l |
| $AlPO_4$ (aluminum phosphate) | 10 g/l |
| beechwood extracts | 5 ml/l |

The parts are exposed in two stages. In the first stage, a temperature of about 80° C. and a current density of about 3 amp/dm$^2$ are employed, and in the second stage, a temperature of about 70° C. and a current density of about 1.5–2 amp/dm$^2$ are employed. Due to the higher operating temperature in the first stage, a greater removal of material is obtained.

The parts are exposed for a total period of time of about 18 minutes. The voltage applied is interrupted for about 2 to 10 seconds about one minute before the end of the exposure time. The particularly advantageous result is thereby obtained that the gloss film produced upon the brightening is in greater part removed without etching the surface.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for brightening aluminum or aluminum alloy parts, comprising treating said parts in an alkaline electrolyte, subjected to direct current, said alkaline electrolyte comprising trisodium phosphate, disodium carbonate, aluminum phosphate, and beechwood extracts.

2. A brightening method according to claim 1, wherein said alkaline electrolyte comprises:

| | |
|---|---|
| trisodium phosphate | 120 g/l |
| disodium carbonate | 330 g/l |
| aluminum phosphate | 10 g/l |
| beechwood extracts | 5 ml/l |

3. A brightening method according to claim 1, wherein said parts are subjected in the electrolyte to a two stage treatment, the parts being prebrightened in the first stage at an operating temperature of about 80° C. and then after-brightened in the second stage at an operating temperature of about 70° C.

4. A brightening method according to claim 3, wherein said parts are exposed in the first treatment stage with a current density of about 3 amp/dm$^2$ and in the second treatment stage with a current density of about 1.5–2 amp/dm$^2$.

5. A brightening method according to claim 1, wherein said parts are exposed for a total of about 18 minutes.

6. A brightening method according to claim 1, wherein the current voltage applied is interrupted for about 2–10 seconds about one minute before the end of the exposure time.

7. A brightening method according to claim 1, wherein the electrolyte is filtered, the filter cake produced thereby is washed, and the chemicals recovered in dissolved form in this operation are returned to the electrolyte.

8. A brightening method according to claim 1, wherein said parts are treated in a cathodically connected container of structural steel, the parts being used as anodes.

9. A brightening method according to claim 8, wherein said container is provided with heating and/or cooling means.

10. A brightening method according to claim 8, wherein said container has overflow means leading to a filter station and feed means coming from the filter station.

* * * * *